United States Patent [19]

Kojima et al.

[11] Patent Number: 4,763,590

[45] Date of Patent: Aug. 16, 1988

[54] RESIDUAL THREAD CHAIN BACK TACKING DEVICE FOR OVERLOCK STITCH MACHINES

[75] Inventors: Toshihiko Kojima, Hyogo; Toshiaki Kajio, Minoo, both of Japan

[73] Assignee: Yamato Mishin Seizo Kabushiki Kaisha, Osaka, Japan

[21] Appl. No.: 32,589

[22] Filed: Apr. 1, 1987

[30] Foreign Application Priority Data

Sep. 22, 1986 [JP] Japan ..... 61-224099

[51] Int. Cl.[4] ..... D05B 65/06

[52] U.S. Cl. ..... 112/287; 112/288; 112/DIG. 1

[58] Field of Search ..... 112/287, 288, 293, DIG. 1

[56] References Cited

U.S. PATENT DOCUMENTS 4,478,163 10/1984 Keeton ..... 112/287
4,644,884 2/1987 Tatsumi ..... 112/288
4,672,902 6/1987 Michaels ..... 112/287

FOREIGN PATENT DOCUMENTS 56-50599 11/1981 Japan .
6145797 8/1984 Japan ..... 112/288

*Primary Examiner*—Peter Nerbun
*Attorney, Agent, or Firm*—Wenderoth, Lind & Ponack

[57] ABSTRACT

A residual thread chain back tacking device for stitching a residual thread chain in the proper position of a succeeding sewn cloth material has a thread chain cutting device which initially cuts most of the thread chain off, and then blows the remaining thread chain in the back tacking direction and horizontally. A thread chain suction pipe moves adjacent the back tacking position and sucks the remainder of the thread chain thereinto and holds it by means of a thread chain press cylinder while back tacking is completed. An air nozzle then blows the remaining thread chain against a cutter, and the suction in the thread chain suction pipe sucks the cut-off end away.

1 Claim, 4 Drawing Sheets

RESIDUAL THREAD CHAIN BACK TACKING DEVICE FOR OVERLOCK STITCH MACHINES

BACKGROUND OF THE INVENTION

1. Field of the Invention

This invention relates to a residual thread chain back tacking device to stitch a residual thread chain off into preceding sewn cloth in starting the seam of a succeeding sewn cloth so as to prevent fraying of a sewing starting part.

2. Description of the Prior Art

As a means of stitching a residual thread chain in a sewing starting seam on an overlock stitch machine, Japanese Patent Application Publication No. 61-50599 and Japanese Patent Application Laid Open Publication No. 61-45797 disclose such means. However, in both cases it is difficult to keep the thread chain in a stabilized state at the specified position for the succeeding sewing operation and accordingly the thread chain cannot be stitched in perfectly.

SUMMARY OF THE INVENTION

The present invention has for its object to eliminate the drawbacks of the conventional overlock stitch machine, such as difficulty of keeping a thread chain in the stabilized state at the specified position for the succeeding sewn cloth and resultant deterioration of the finished goods and production of inferior goods.

BRIEF DESCRIPTION OF THE DRAWINGS

The attached drawings show an embodiment of the present invention, in which.

DETAILED DESCRIPTION OF THE PRESENT INVENTION

In order to attain the above object, the present invention provides a device by which a thread chain is guided to and stabilized at the proper position by an ingenious sucking and discharging action and thus the thread chain can be back tacked in good condition.

A description is given below of the present invention with reference to the accompanying drawings showing an embodiment of the present invention.

Figure 1:
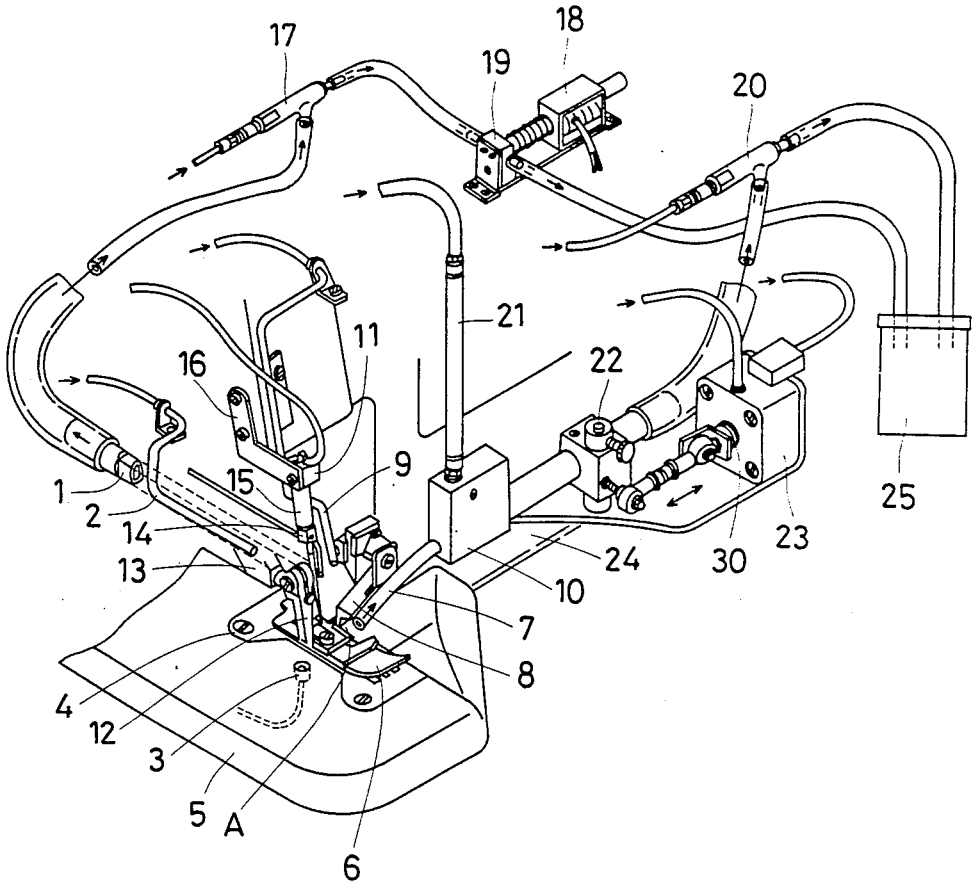
FIG. 1 is a perspective view of the device according to the present invention.
Figure 2:
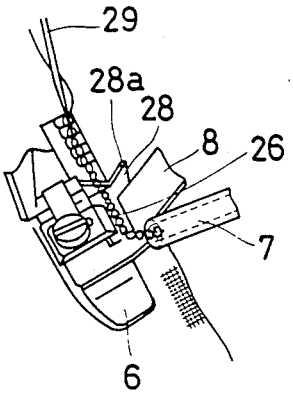
FIG. 2 is a perspective view of a press paw part during the sewing operation.
Figure 3:
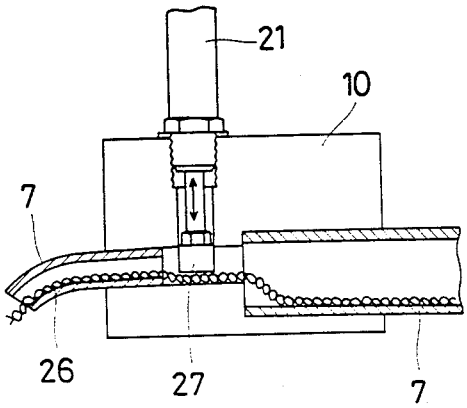
FIG. 3 is a side view of a thread chain presser.
Figure 4:
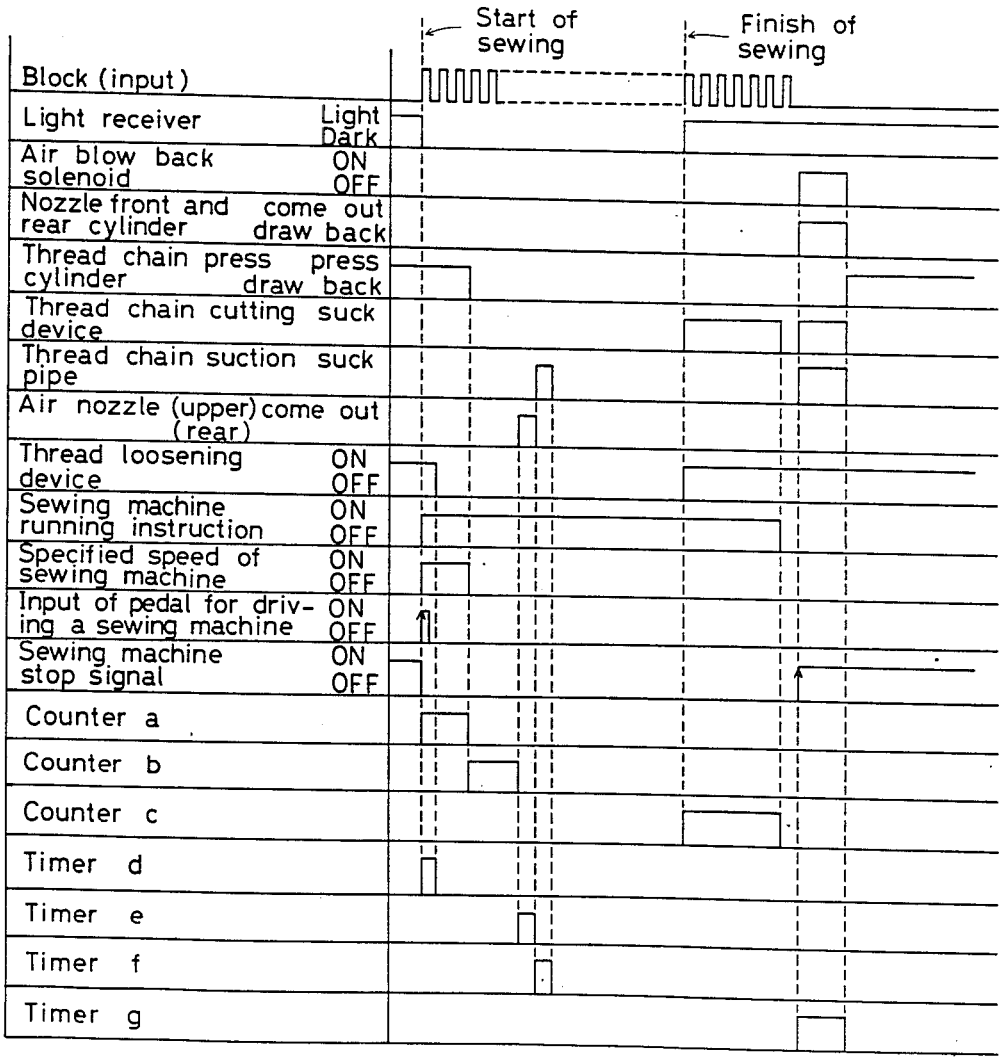
FIG. 4 is a timing chart.

Reference numeral 1 designates a conventional thread chain cutting device which cuts off most of a surplus thread chain after the finish of overedging and then removes it by suction. Reference numeral 2 designates a rear air nozzle which guides a thread chain 26 to the sewing position and stabilizes it there. Reference numeral 3 designates an emission catcher. During the sewing operation, the emission catcher 3 is "dark" because cloth material covers it, but after the finish of sewing operation the emission catcher 3 is "light" because the material has passed by the emission catcher 3 and does not cover it. By the change between "dark" and "light" of the emission catcher 3, presence and absence of material is detected. Reference numeral 4 designates a throat plate and reference numeral 5 designates a cloth plate. Reference numeral 6 designates a presser foot which feeds material, in concert with feed dogs (not shown in the drawing). Reference numeral 7 designates a thread chain suction pipe which sucks a thread chain. Reference numeral 8 designates an upper knife which cuts a thread chain 26 and a cloth edge, in concert with a lower knife (not shown in the drawing). Reference numeral 9 designates a front air nozzle which determines the position of a thread chain and the length of the thread chain which is stitched in so that the thread chain can be stitched in a seam perfectly. Reference numeral 10 designates a thread chain pressing cylinder fitting table, to which the thread chain suction pipe 7 and thread chain pressing cylinder 21 are fitted. Reference numeral 11 designates a light emitter which detects the presence of material, in concert with the emission catcher 3. Reference numeral 12 designates a press hinge which presses the presser foot 6. Reference numeral 13 designates a press arm which is fitted to the press hinge 12 and fixes the presser foot 6 as a whole. Reference numerals 14, 15 and 16 designates a needle clamp, a needle bar and a light emitter bracket respectively. Reference numeral 17 designates a Venturi tube which switches a positive pressure of the air to a negative pressure. Reference numeral 19 designates an air blow back valve which intercepts an air flow path from the Venturi tube 17 and blows back the air to a thread chain cutting device 1. Reference numeral 18 designates an air blow back solenoid which controls the opening and shutting of the air blow back valve 19. Reference numeral 20 designates another Venturi tube which performs the same action as the Venturi tube 17. Reference numeral 21 designates a thread chain press cylinder which is a housing for containing means for pressing a thread chain 26 in the form of a thread chain presser 27, as shown in FIG. 3. Reference numeral 22 designates a rotatable shaft which turns both in normal and reverse directions, being driven by an air cylinder 23 and rod 30, for driving the thread chain suction pipe 7 around the shaft 22 as a fulcrum for rocking the thread chain suction pipe 7 frontward and backward. The cylinder 23 for driving the thread chain suction pipe 7 causes the suction pipe 7 to advance and retreat through by rotation of the rotative shaft 22. Reference numeral 24 designates a sewing machine body. Reference numeral 25 designates a dust bin in which cut off thread chains are collected. Reference numeral 28 designates a press paw. Reference numeral **28*a* designates a guide part which has an upper surface with an inverted-angle shape, as shown in FIG. 2, and guides the thread chain 26 to the proper sewing position by guiding it to the lowermost part thereof. Reference numeral 29** designates a needle.

Figure 5:
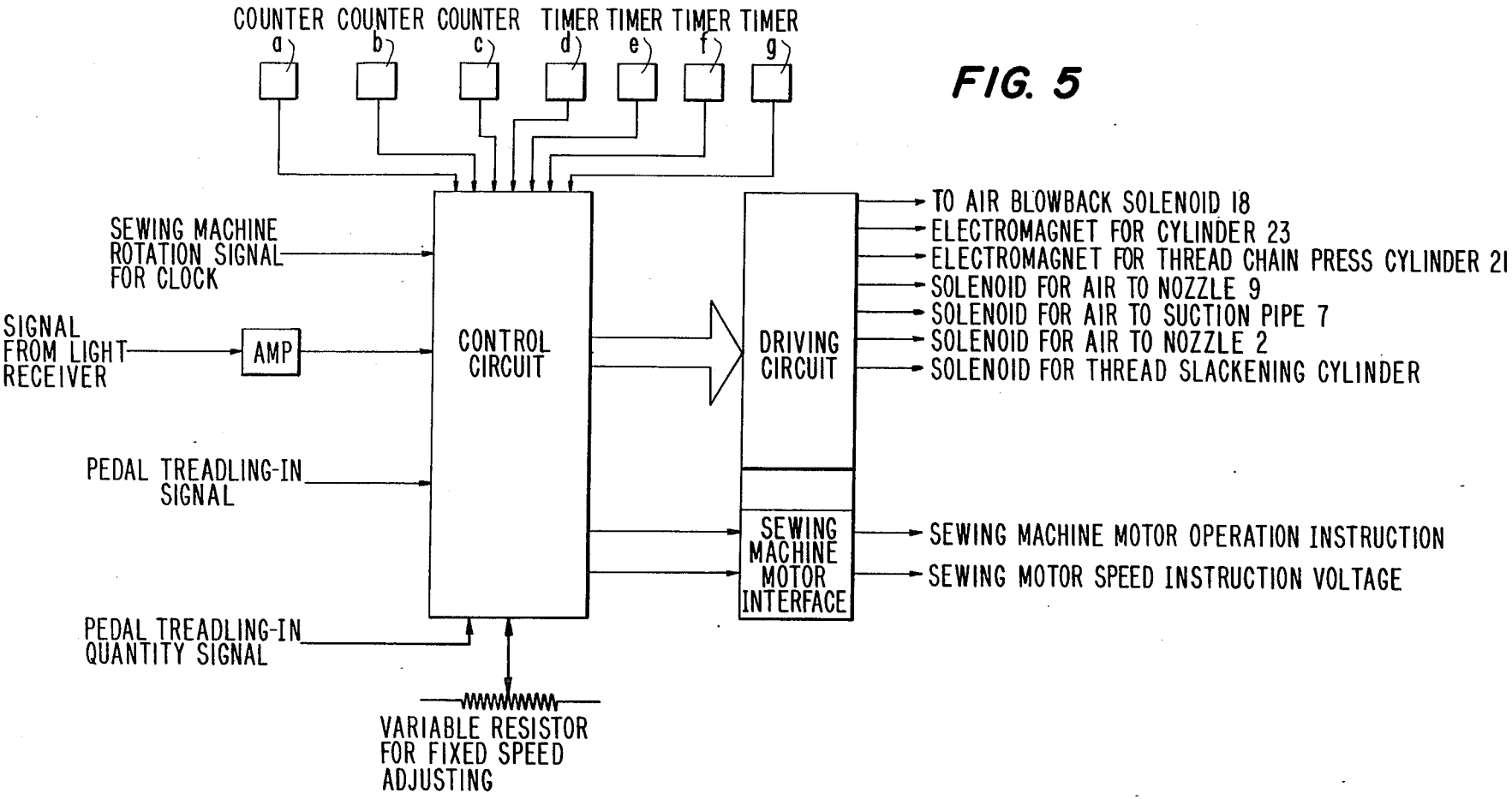
FIG. 5 is a circuit diagram.

As shown in FIG. 5, a control circuit is provided which receives input from counters a, b and c and from various timers d, e, f and g, from light receiver 3 and from the sewing machine operator. It controls a driving circuit which controls the sewing machine motor and the various solenoids and cylinders.

The present invention is constructed as described above and its action is described below.

When sewing of a material is finished, the emission catcher 3 changes to "light" from "dark", whereupon the thread chain cutting device 1 starts a suction action which causes most of the thread chain sucked thereinto to be cut off by cutting means (not visible), and the conventional thread tension releasing device starts a thread tension releasing action to change the thread chain for seaming to a soft chain. At this time, the sewing machine motor rotates under the control of a counter c for regulating a predetermined length of a sewing finishing thread chain 26 and when the thread chain is stitched in the specified length, rotation of the sewing machine motor is stopped and at the same time the suction action of the thread cutting device 1 is also stopped, after which a signal for sewing machine stoppage is given, the rod 30 of the air cylinder 23 for driving thread chain suction pipe 7 begins to move leftward, the thread chain suction pipe 7 rocks on the shaft 22 as a fulcrum and as soon as the thread chain suction pipe 7 approaches the needle drop part, it starts suction action. On the other hand, a timer g also starts operation, the air blow back solenoid 18 is electrified for the time during which the timer g operates, the air is blown backward to the thread cutting device 1 through the air blow back valve 19 and the thread chain suction pipe 7 sucks in the part of the thread chain 26 which has not been cut off by the thread cutter 1. Then, after the timer g operates for the preset time, the air blow back solenoid 18 turns "OFF" and the rod 30 of the air cylinder for driving thread chain suction pipe 7 retreats rightward, whereupon the thread chain suction pipe 7 stops the suction action. At this time, the thread chain press cylinder 21 starts action and the thread chain presser 27 descends and presses the thread chain 26. Then, a presser foot lifting pedal is operated and a material is loaded in between the presser foot 6 and the upper surface of the throat plate 4 up to the part A of the upper knife 8, whereupon the emission catcher 3 changes to "dark" from "light". The thread tension releasing device which has been operating stops its thread tension releasing action after the thread tension releasing timer d, which regulates the preset action of the conventional thread tension releasing device at start of sewing, operates for the specified time and thus the usual sewing condition is restored. Then, if a pedal for driving a sewing machine is operated, the sewing machine is run at the specified speed while the counter a, which operates at the specified speed predetermined in consideration of the time-lag of the thread chain press cylinder 21, counts the preset number and as soon as the counting of the counter a is finished, back tacking is finished. At the same time, the thread chain press cylinder 21 ascends and the thread chain presser 27 releases the remaining thread chain 26 so that it is in a free state. When the preset counting of the counter a is finished, the preset air in the front air nozzle 9 and the rear air nozzle 2 counts the number of the counter b and when the counting is finished, the rear air nozzle 2 blows thread chain 26 just in the back tacking direction and horizontally for the preset time of the timer e, and the front air nozzle 9 blows from above so that the thread chain does not swing right and left. Thus, by the combined action of the two air nozzles, the thread chain 26 is guided to the back tacking position accurately. Then, the front air nozzle 9 blows the thread chain against the cutting device 8, by which the remainder of the thread chain 26 is cut off and as soon as the action of the timer e is finished, air is fed for the preset time of the timer f of the thread chain suction pipe 7 and the suction air is fed to the thread chain suction pipe 7 by the action of the Venturi tube 20, so that thread chain remaining in the tube 7 after the cutting action is sent to the suction dust bin.

What is claimed is:

1. In an overlock stitch machine having a thread chain presser, a residual thread chain back tacking device for allowing stitching of a residual thread chain in the proper position of a succeeding sewn cloth material, comprising:

a thread chain cutting device;

a Venturi tube connected to said thread chain cutting device for exerting suction thereon;

an air blow back valve connected to said Venturi tube downstream thereof for intercepting the air flow path from said Venturi tube and to blow back air to said thread chain cutting device;

an air blow back solenoid connected to said air blow back valve for opening and closing it;

a counter device for regulating the length of thread chain to be stitched in;

a guide part and a press paw for guiding a thread chain to the sewing position and stabilizing it;

cutter means adjacent said guide part and press paw;

a rear air nozzle for blowing a thread chain from said thread chain cutting device only in the back tacking direction and horizontally;

a front air nozzle for blowing on a thread chain from above so that the thread chain does not swing back and forth and is guided to the proper position to be stitched in and blowing the thread chain against said cutting means to determine the length of thread chain to be stitched in;

a thread chain suction pipe mounted for movement of the suction end of said thread chain suction pipe toward and away from the stitching position and having suction means connected thereto for exerting suction on said thread chain suction pipe, and means for moving said thread chain suction pipe in said movement;

a thread chain press cylinder having a thread chain presser operatively associated with said thread chain suction pipe; and control means connected to said thread chain suction pipe moving means and said thread chain press cylinder for moving said thread chain suction pipe toward said stitching position upon finishing of stitching for picking up the thread chain from said thread chain cutting device and moving said thread chain suction pipe away from said stitching position when the thread chain has been picked up in said thread chain suction pipe and for operating said thread chain press cylinder for pressing the thread chain in said thread chain suction pipe and releasing it in timed sequence to the operation of said device for enabling said further Venturi tube to suck away the cut off end of the thread chain.

* * * * *